US005610695A

United States Patent [19]

Mizutani et al.

[11] Patent Number: 5,610,695

[45] Date of Patent: Mar. 11, 1997

[54] ROLLER FOR ELECTROPHOTOGRAPHIC DEVELOPMENT APPARATUS

[75] Inventors: Takao Mizutani; Hirokazu Ando; Hiroshi Kikuchi, all of Tokyo, Japan

[73] Assignee: Oki Electric Industry Co., Ltd., Tokyo, Japan

[21] Appl. No.: 526,214

[22] Filed: Sep. 11, 1995

[30] Foreign Application Priority Data

Sep. 9, 1994 [JP] Japan ..... 6-242238

[51] Int. Cl.[6] ..... G03G 15/08

[52] U.S. Cl. ..... 399/284; 492/30; 492/56; 428/36.8; 399/285

[58] Field of Search ..... 355/259, 219, 355/245; 492/28, 30, 53, 56; 118/653; 428/36.8, 36.91, 36.92

[56] References Cited

U.S. PATENT DOCUMENTS

| | | | |
|---|---|---|---|
| 4,760,422 | 7/1988 | Seimiya et al. | 118/656 X |
| 5,062,385 | 11/1991 | Nishio et al. | 118/653 |
| 5,164,773 | 11/1992 | Nishio et al. | 355/245 |
| 5,434,653 | 7/1995 | Takizawa et al. | 355/259 |
| 5,443,873 | 8/1995 | Itani et al. | 428/36.5 |
| 5,458,937 | 10/1995 | Nakamura et al. | 428/36.91 |

FOREIGN PATENT DOCUMENTS

| | | |
|---|---|---|
| 3-20763 | 1/1991 | Japan . |
| 4-133077 | 5/1992 | Japan . |

*Primary Examiner*—R. L. Moses

*Attorney, Agent, or Firm*—Law Office of Steven M. Rabin, P.C.

[57] ABSTRACT

An electrophotographic development apparatus capable of maintaining the surface roughness of a developer roller thereof for a long term or even for the life span of the apparatus. The developer roller includes an elastic layer, formed on a core metal shaft, and made of a rubber elastic material with additional insulating micro-powder of 30 to 200 parts having a particle diameter in a range of 1 to 50 micrometers, where the amount of the rubber elastic material constitutes 100 parts. During a printing operation, the insulating micro-powder drops from the elastic layer as the rubber elastic material is worn, so that the developer roller can maintain its surface roughness in proportion to the particle diameter of the dropped powder.

16 Claims, 5 Drawing Sheets

ROLLER FOR ELECTROPHOTOGRAPHIC DEVELOPMENT APPARATUS

Reference to the Related Application

This application claims the priority right of Japanese Patent Application No. Hei 06-242238 filed on Sep. 9, 1994, the entire disclosure of which is incorporated herein by reference.

BACKGROUND OF THE INVENTION

1. Field of the Invention

This invention relates to a development apparatus for developing electrostatic latent images using an electrophotographic apparatus and, more particularly, to a developer roller for a nonmagnetic one-component development system (hereinafter abbreviated as a "one-component developer").

2. Description of Related Art

Some electrophotographic photocopiers, printers, and facsimile machines use a one-component developer to make the development unit compact. In such a development apparatus using a one-component developer, a developer roller lies close to or in contact with a drum-shaped latent image carrier (photosensitive body) on which an electrostatic latent image is formed. Toner from a toner cartridge is supplied on the surface of the developer roller by a toner supply roller. The supplied toner is made thinner or smoothed by a doctor blade, for restricting the thickness of the toner layer disposed close to the surface of the developer roller, according to the revolution of the developer roller, and is triboelectrically charged to a predetermined polarity. Toner that has passed the doctor blade is transported to or in contact with the surface of the developer roller and is held by its charges, and is then conveyed to a development zone at which the developer roller and the photosensitive body meet with each other. The toner is then transferred onto the electrostatic latent image formed on the surface of the photosensitive body, thereby visualizing the electrostatic latent image.

FIG. 8 is a cross sectional view of a conventional developer roller. As shown in FIG. 8, the developer roller is typically constituted of a rubber elastic layer 5 formed at the outer round surface of a shaft 3. The surface of the developer roller i is ground so as to have a ten point mean roughness Rz of about 4 to 10 micrometers, to obtain mean toner thickness of 20 micrometers, which result in an excellent print density. The mean toner thickness necessary to obtain an excellent print density may vary depending on the kinds and amounts of carbon used as a coloring material for the toner, and the bulk density of toner particles in a toner layer. A spherical shaped toner is used, which is obtained by suspension polymerization of a binder polymer with a coloring material. For example, styrene-butyl acrylatc copolymer of 100 parts by weight is used as the binder polymer. Carbon black (a trade name, made by Denki Kagaku K.K.) of 8 parts by weight, low molecular weight polypropylene of 4 parts by weight, and dye containing metal of 2 parts by are used as the coloring material, and which are compounded and formed.

The developer roller 1, however, during a printing operation, rubs the toner supply roller, the doctor blade, and the photosensitive body with contact pressure thorugh the toner. Therefore, the roughness on the surface of the developer roller becomes worn out, and the surface roughness Rz falls 1 to 2 micrometers when about 2,000 sheets have been printed, thereby reducing the toner thickness after the doctor blade is applied, to about 10 to 15 micrometers, thereby possibly rendering the printing density lower.

The degree of such abrasion depends on the abrasion resistance of the rubber elastic material of the developer roller 1 or on the form of the toner particle. In the case that silicone rubber is used, the roller would have worse abrasion resistance than if urethane rubber were used; in the case of toner made by pulverizing a lump of toner material, the roller has much worse abrasion resistance than in the case when the spherical toner is made by polymerization.

SUMMARY OF THE INVENTION

It is an object of the invention to provide a developer roller which keeps its surface rough, which enables an electrophotographic development apparatus to maintain excellent printing density for a long term or even for its life span.

The foregoing object is accomplished with a developer roller constituted of a shaft and an elastic layer for holding toner, formed on the shaft, made of rubber elastic material, and including insulating micro-powder of 30 to 200 parts having a diameter in a range of 1 to 50 micrometers, where the amount of said rubber elastic material constitutes 100 parts.

During a printing operation, the surface of the elastic layer of the developer roller is rubbed through toner by the toner supply roller, the doctor blade, and the photosensitive body in pressure contact with it. Since the rubber elastic material differs from the additive powder in abrasion resistance, the rubber elastic material is more shaved than the additive powder, and therefore the additive powder being extruded from the surface of the elastic layer is uniformly dispersed in the rubber elastic material. Furthermore, when the rubber elastic material is shaved, the additive powder drops off from the surface of the elastic layer. The surface of the elastic layer is maintained perpetually rugged by the extruded and dropped off portions of the additive powder so that the surface roughness of the developer roller is preserved constant in proportion to particle diameter of the additive powder.

BRIEF DESCRIPTION OF THE DRAWINGS

The above and other objects and features of the invention are apparent to those skilled in the art from the following description of the preferred embodiments thereof when considered in conjunction with the accompanied drawings, in which.

DETAILED DESCRIPTION OF THE PREFERRED EMBODIMENTS

Figure 1:
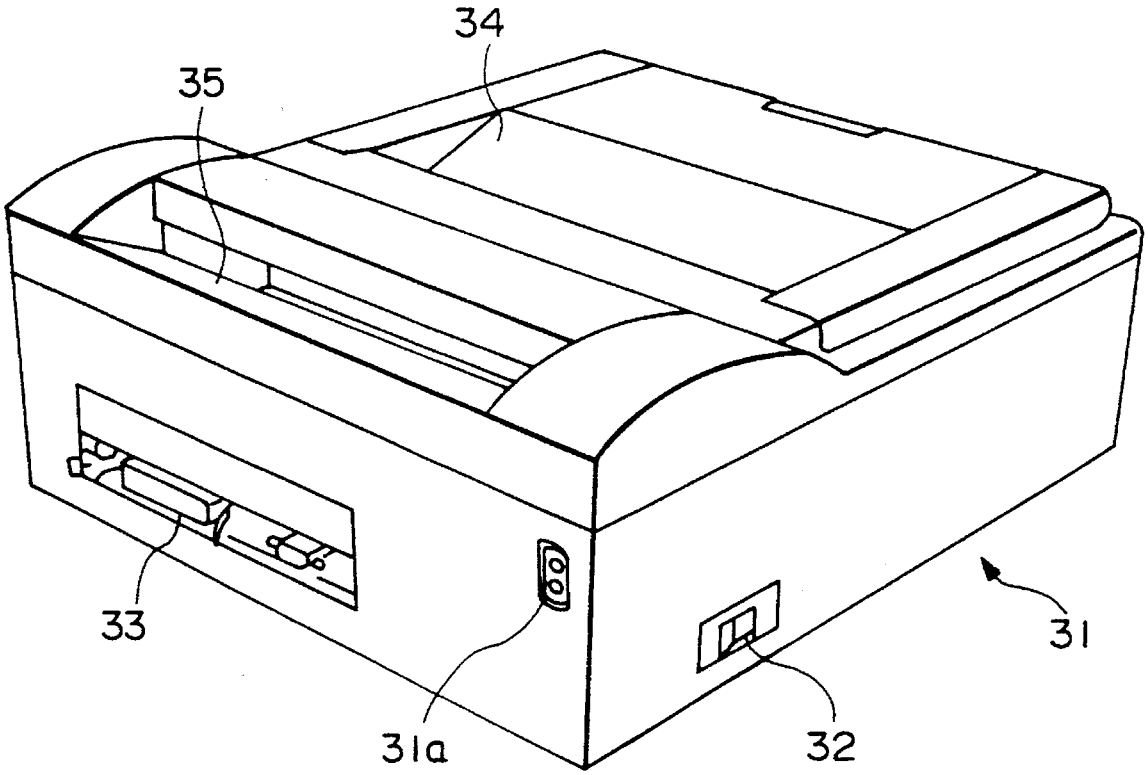
FIG. 1 is a perspective view illustrating an electrophotographic printer according to the present invention.
Figure 2:
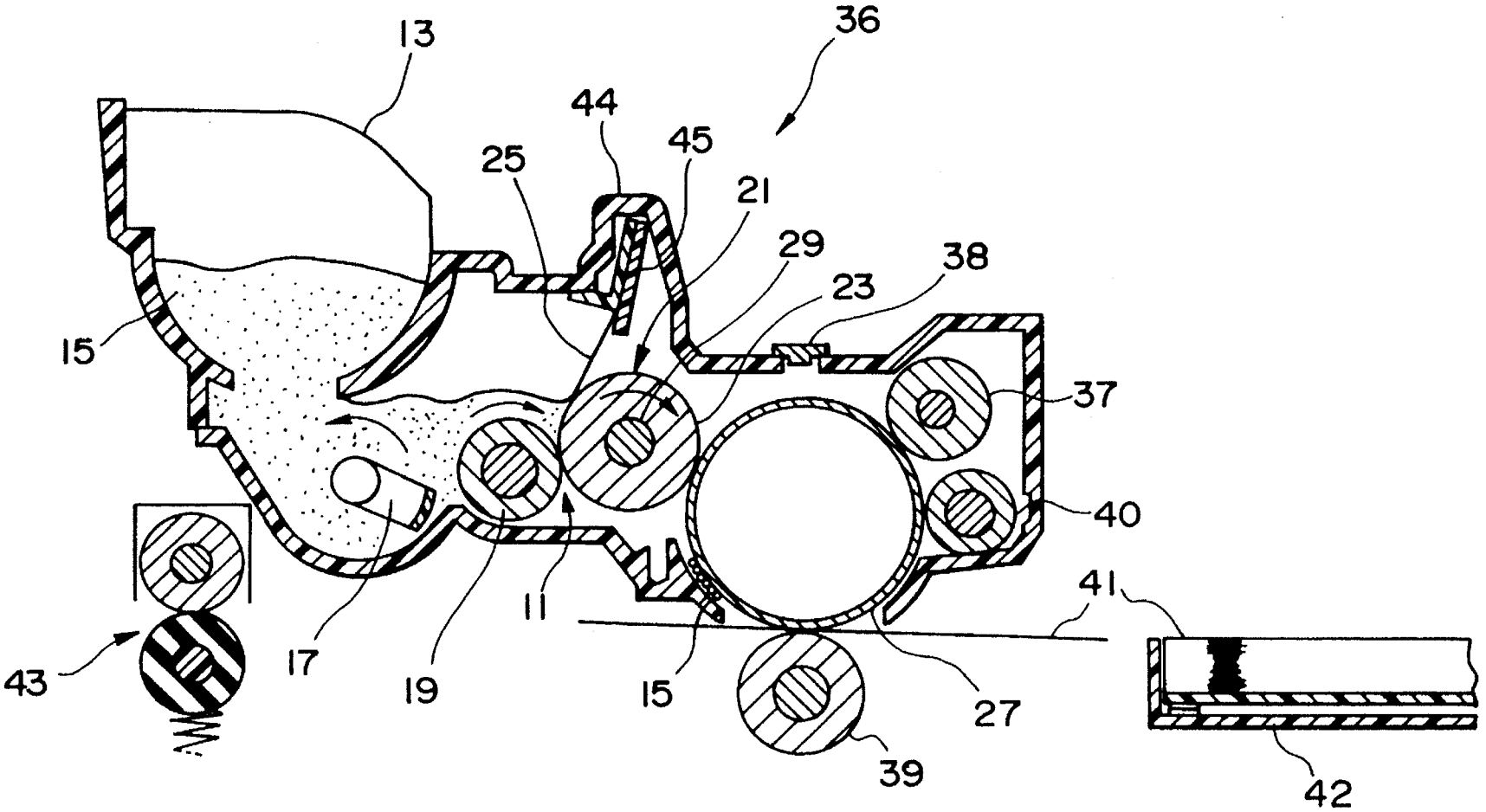
FIG. 2 is a cross-sectional view illustrating an image formation unit.

FIG. 1 is a perspective view illustrating an electrophotographic printer according to the present invention and FIG. 2 is a cross-sectional view illustrating an image formation unit.

In FIG. 1, an electrophotographic printer 31 incorporates therein an image formation unit which will be described later. There are disposed a power switch 32, a connector 33, and a jack 31*a* or the like on the outer side surface of the electrophotographic printer 31. There are also disposed stackers 34, 35 on the upper surface of the printer 31 in order to eject a printed paper.

In FIG. 2, an image formation unit 36 is constructed by disposing, at the periphery of a photosensitive body 27, an electro charging roller 37, an LED (light emitting diode) array head 38, a development apparatus 11, an image transfer roller 39, and a cleaning roller 40. There are also disposed at either side a hopper 42 which contains paper 41, and a fusing apparatus 43.

Toner 15 is contained in a toner cartridge 13 attached to the electrophotographic development apparatus 11 and is transported by an agitator 17 to a toner supply roller 19 that revolves in the clockwise direction when seen as in FIG. 2. A developer roller 21 is placed close to or in contact with the toner supply roller 19 and is supplied with the toner 15 on an elastic layer 23 on its surface by the toner supply roller 19. The toner 15 supplied on the surface of the elastic layer 23 is held and triboelectrically charged to a predetermined polarity, according to revolution of the developer roller 21, and is also made thinner by a doctor blade 25 used as a toner thickness restricting member. The doctor blade 25 is supported by a supporting member 45 which is attached to a frame 44. The toner 15 held on the elastic layer 23 of the developer roller 21 is then conveyed to a development zone where the developer roller 21 meets a photosensitive body 27, thereby being electrostatically transferred onto an electrostatic latent image formed on the surface of the photosensitive body 27 to visualize the electrostatic latent images.

Figure 3:
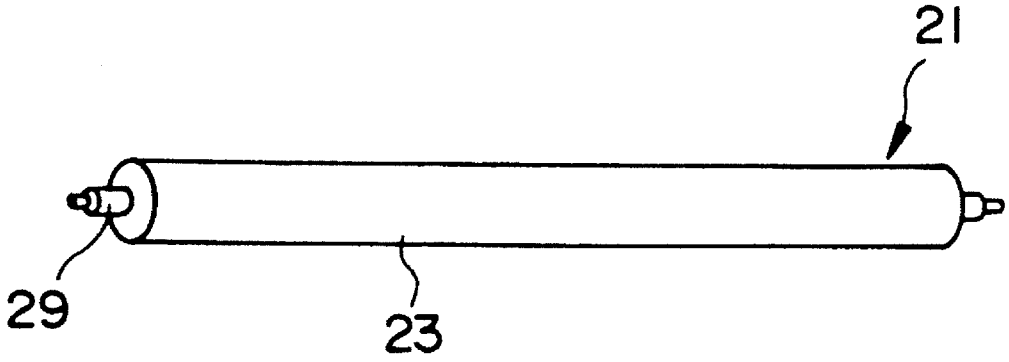
FIG. 3 is a perspective view illustrating a developer roller according to the present invention.
Figure 4:
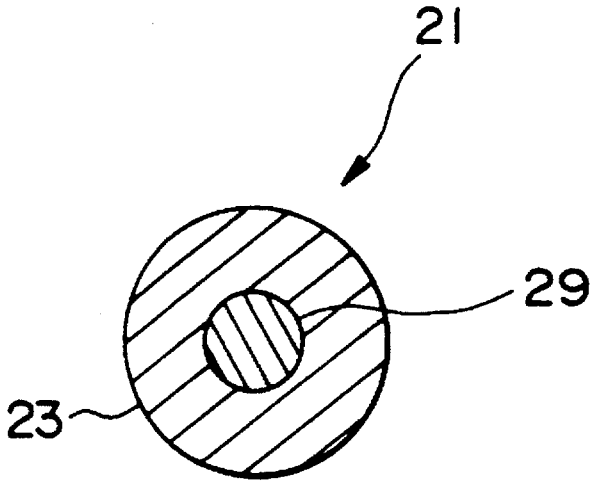
FIG. 4 is a cross-sectional view illustrating a developer roller according to the present invention.

FIG. 3 is a perspective view illustrating a developer roller according to the present invention and FIG. 4 is a cross sectional view illustrating a developer roller according to the present invention.

The developer roller 21 in the development apparatus 11 is constituted of the elastic layer 23 formed at the outer round surface of a shaft 29 as shown in FIGS. 3, 4. The developer roller 21 is constructed in accordance with the following examples. The following examples describe preferred compositions of the elastic layer 23 and should not be interpreted as limiting the scope of the invention defined in the accompanying claims.

EXAMPLE 1

Figure 5:
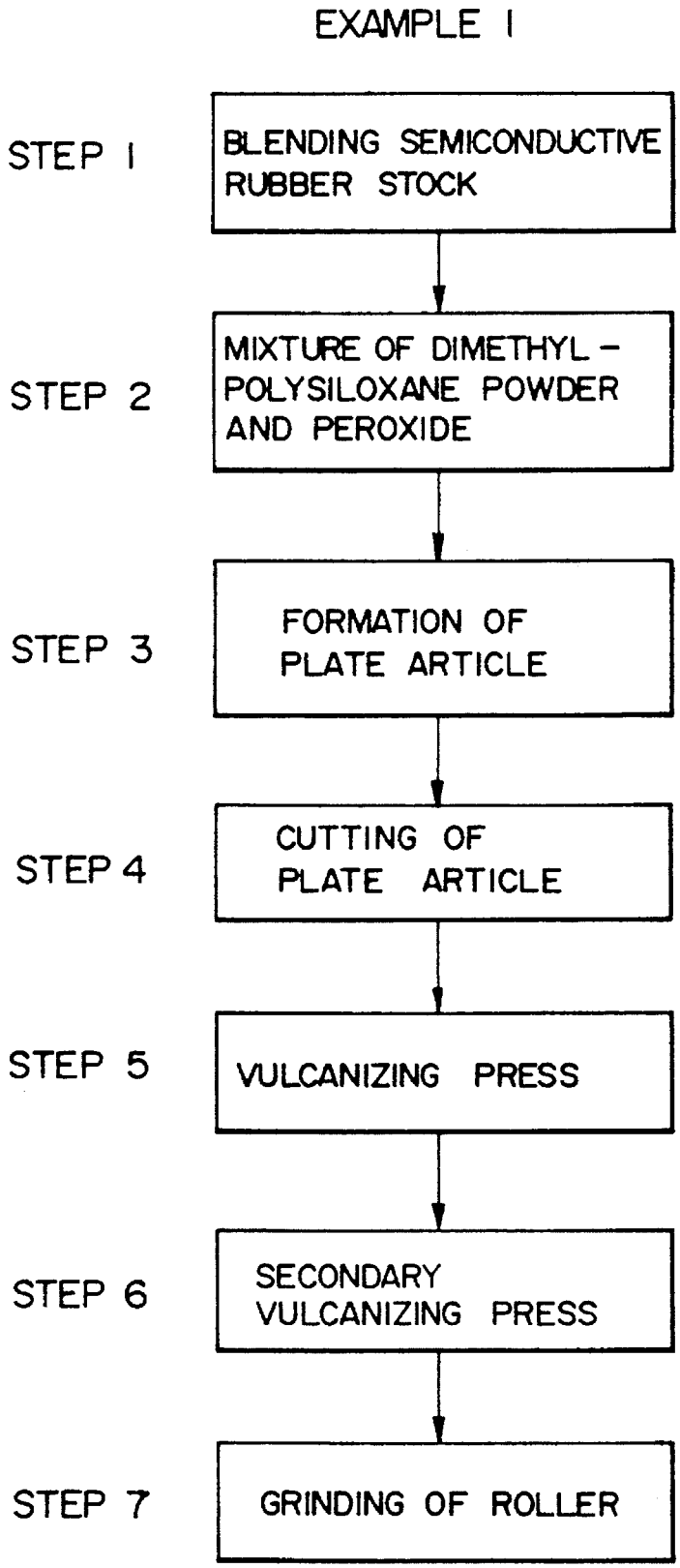
FIG. 5 is a flowchart illustrating manufacturing steps of the developer roller according to the present invention.

FIG. 5 is a flowchart illustrating manufacturing steps of the developer roller according to the present invention.

In Step 1 in FIG. 5, to blend semiconductive silicone rubber stock as the rubber elastic material, 100 parts dimethyl-polysiloxane raw rubber, in which both ends of its molecule were added to dimethyl-vinyl-siloxy groups, 20 parts carbon black having a surface area of 70 square meters per gram, and 20 parts fumed silica, were uniformly mixed. In Step 2, 130 parts insulating silicone powder, such as dimethylpolysiloxane powder having a powder particle diameter of 5 to 20 micrometers, and 0.5 parts di-t-butylperoxide were then added with 100 parts silicone rubber stock, and were mixed uniformly. In Step 3, the mixture was molded into a plate article, and in Step 4, the plate article was cut. A shaft (see FIG. 4) was then placed so as to be surrounded by the plate article, and they were fitted into a mold. After being subject to a vulcanizing press of 200 kilograms per square centimeters at 170° C. for 15 minutes in Step 5, a roller is formed as shown schematically in FIG. 4. It was vulcanized a second time at 200° C. for 21 hours in Step 6. A developer roller was thereby formed upon grinding the surface of the elastic layer to a predetermined size in Step 7.

The obtained developer roller was incorporated in the electrophotographic development apparatus I 1. Almost no change of printing density was observed when the printing density was evaluated where 20,000 sheets were actually printed using the electrophotographic development apparatus 11. When measured, the surface roughness Rz of the elastic layer, which was originally of 8 to 10 micrometers, was 8 to 10 micrometers even after 20,000 sheets had been printed, and it turned out that the surface roughness of the developer roller did not change.

Figure 6:
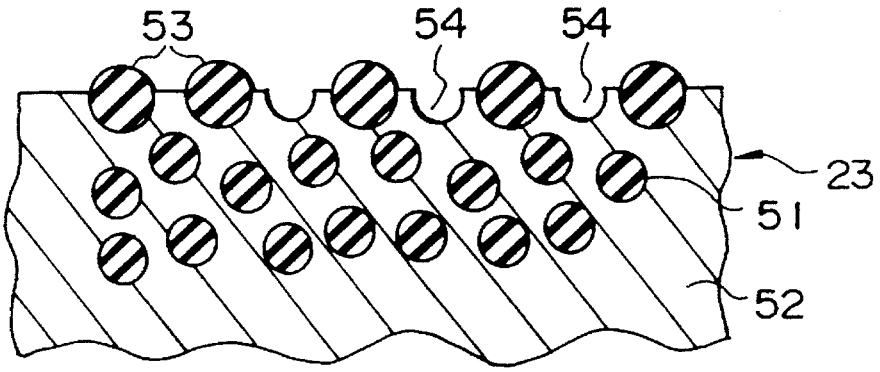
FIG. 6 is an enlarged cross-sectional view illustrating an elastic layer obtained in Example 1.

The reason is as follows. FIG. 6 is an enlarged cross sectional view illustrating an elastic layer constructed as in Example 1.

In FIG. 6, additive dimethyl-polysiloxane powder 51 is dispersed uniformly in semiconductive silicone rubber stock 52 of the elastic layer 23. During a printing operation, the surface of the elastic layer 23 of the developer roller 21 shown in FIG. 2 is rubbed through the toner 15 by the toner supply roller 19, the doctor blade 25, and the photosensitive body 27 in pressure contact with it. Since the semiconductive silicone rubber stock 52 differs from the powder 51 in abrasion resistance, the semiconductive silicone rubber stock 52 is more shaved than the powder 51, and therefore the powder 51 is extruded from the surface of the elastic layer 23.

When the semiconductive silicone rubber stock 52 is further shaved, the powder 51 drops off from the surface of the elastic layer 23. The surface of the elastic layer 23 is maintained perpetually rugged by the extruded portion 53 of the powder 51 and the dropped off portion 54 so that the surface roughness of the developer roller 21 is preserved to be constant in proportion to the particle diameter of 5 to 20 micrometers of the powder 51. As a result, the developer roller can keep its surface roughness constant for a long term or even for the life span of the apparatus.

EXAMPLE 2

The same result as Example 1 was obtained, where 130 parts spherical glass micro-powder having a particle diameter of 5 to 20 micrometers, was blended in lieu of the silicone powder in Example 1, to form an elastic layer for a developer roller.

EXAMPLE 3

The same result as Example 1 was obtained, where 130 parts spherical silica having a particle diameter of 5 to 10 micrometers, was blended in lieu of the silicone powder in Example 1, to form, in substantially the same manner, an elastic layer for a developer roller, and where a printing test was conducted.

EXAMPLE 4

In Example 4, the electrically insulating micro-powder was not added into the rubber elastic material. Instead, in Step 2 of Example 1, di-t-butyl-peroxide and a foam blowing agent were mixed into the semiconductive silicone rubber stock. By performing thereafter the same process steps as those of Example 1, a micro-foam sponge expanded 1.3 to 3 times containing bubbles having cell size of 2 to 50 micrometers was obtained. The sponge was used to form the elastic layer 23 of the developer roller 21.

Figure 7:
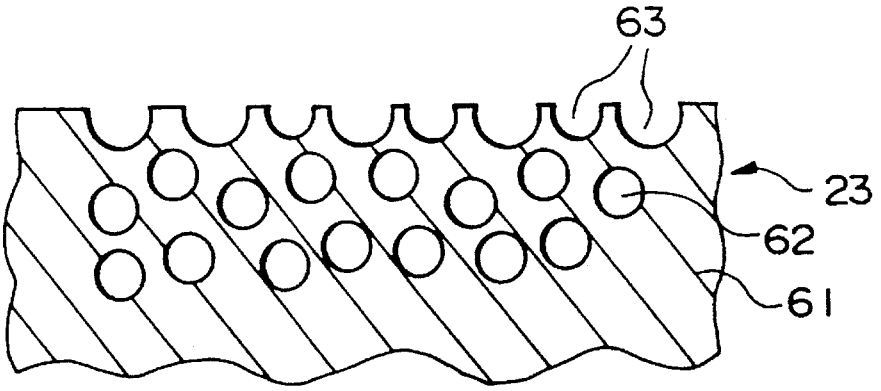
FIG. 7 is an enlarged cross-sectional view illustrating an elastic layer obtained in Example 4.
Figure 8:
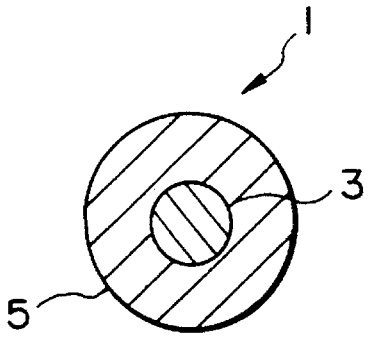
FIG. 8 PRIOR ART
FIG. 8 is a cross-sectional view of a conventional developer roller.

FIG. 7 is an enlarged cross sectional view illustrating an elastic layer obtained in Example 4. In FIG. 7, when the elastic layer 23 is rubbed at its surface during a printing operation, the semiconductive silicone rubber stock 61 is shaved and a recess portion 63 is formed on the surface of the elastic layer 23 due to a micro foam 62 structure dispersed uniformly in the semiconductive silicone rubber stock 61. As described above, the surface roughness of the developer roller 21 is preserved such that it is constant in proportion to the cell size of the microfoam 62, 2 to 50 micrometers. An experimental result to that of Example 1 was obtained when the developer roller 21 according to Example 4 was utilized in an actual printing test.

As described above in detail, within the electrophotographic development apparatus, the developer roller 21 is constituted in part of the elastic layer 23 made of a rubber elastic material with additional insulating micro-powder having particle diameter of 1 to 50 micrometers, of 30 to 200 parts, the rubber elastic material is shaved, and the rugged surface of the elastic layer is maintained by the extruded and dropped off portions of the powder. When the surface of the elastic layer 23 is rubbed through toner 15 during a printing operation, the developer roller 21 can always obtain at its surface a surface roughness in proportion to the particle diameter of the dropped micro-powder. Thus, the developer roller 21 maintains a constant surface roughness for a long term or even for the life span of the apparatus. As a result, the toner thickness formed by the doctor blade 25 remains unchanged from the initial stage, ensuring excellent printing density for a long term.

It is understood that although the present invention has been described in detail with respect to preferred embodiments thereof, various other embodiments and variations are possible to those skilled in the art, which fall within the scope and spirit of the invention, and such other embodiments and variations are intended to be covered by the following claims.

What is claimed is:

1. A developer roller. comprising:

(a) a shaft; and (b) an elastic layer, formed at an outer peripheral surface of the shaft, wherein the elastic layer includes a rubber elastic material containing therein electrically insulating micro-powder distributed substantially uniformly throughout and on the surface of the rubber elastic material, such that a degree of roughness of the outer surface of the elastic layer remains substantially constant as the micro-powder and the rubber elastic material are worn from an outer surface of the elastic layer by friction.

2. The developer roller as set forth in claim 1, for use in combination with an electrophotographic development apparatus, the electrophotographic development apparatus including a toner supply roller for supplying one-component non-magnetic toner onto a surface of the elastic layer, a doctor blade pressed against the elastic layer for triboelectrically charging the toner, and means for forming an electrostatic latent image on a surface of a photosensitive body by supplying the charged toner onto the surface of the photosensitive body.

3. The developer roller as set forth in claim 1, wherein the rubber elastic material includes semiconductive silicone rubber stock.

4. The developer roller as set forth in claim 1, wherein the insulating micro-powder has a particle diameter of 1 to 50 micrometers.

5. The developer roller as set forth in claim 4, wherein the elastic layer includes about 30 parts to about 200 parts of the insulating micro-powder and about 100 parts of the rubber elastic material.

6. The developer roller as set forth in claim 1, wherein the insulating micro-powder includes silicone powder.

7. The developer roller as set forth in claim 1, wherein the insulating micro-powder includes spherical glass micro-powder.

8. The developer roller as set forth in claim 1, wherein the insulating micro-powder includes silica.

9. A developer roller, comprising:

(a) a shaft; and (b) an elastic layer, formed at an outer peripheral surface of the shaft, made of sponge, the sponge including micro-foams substantially uniformly arranged in the elastic layer such that irregularities on a surface of the elastic layer cause a degree of roughness of the surface to remain substantially constant as the elastic layer is worn by friction.

10. The developer roller as set forth in claim 9, for use in combination with an electrophotographic development apparatus, the electrophotographic development apparatus including a toner supply roller for supplying one-component non-magnetic toner onto a surface of the elastic layer, a doctor blade pressed against the elastic layer for triboelectrically charging the toner, and means for forming an electrostatic latent image on a surface of a photosensitive body by visualizing the electrostatic latent image.

11. The developer roller as set forth in claim 9, wherein the sponge includes semiconductive silicone rubber.

12. The developer roller as set forth in claim 9, wherein each of said microfoams of the sponge has a cell size of 2 to 50 micrometers.

13. A method for manufacturing a developer roller, comprising the steps of:

(a) blending semiconductive silicone rubber stock by mixing dimethylpolysiloxane raw rubber with carbon black and fumed silica;

(b) adding silicone powder and di-t-butyl-peroxide to the semiconductive silicone rubber stock and uniformly mixing the silicone powder, di-t-butyl-peroxide, and semiconductive silicone rubber stock;

(c) molding the mixture obtained in said step (b) into a plate article;

(d) cutting the plate article;

(e) surrounding a shaft with the plate article, to form a roller, and press vulcanizing the roller;

(f) again press vulcanizing the roller; and (g) grinding a surface of the roller.

14. A method for manufacturing a developer roller, comprising the steps of:

(a) blending semiconductive silicone rubber stock by mixing dimethylpolysiloxane raw rubber with carbon black and fumed silica;

(b) adding silica and di-t-butyl-peroxide to the semiconductive silicone rubber stock and uniformly mixing the silica, di-t-butyl-peroxide, and semiconductive silicone rubber stock;

(c) molding the mixture obtained in said step (b) into a plate article;

(d) cutting the plate article;

(e) surrounding a shaft with the plate article, to form a roller, and press vulcanizing the roller;

(f) again press vulcanizing the roller; and (g) grinding a surface of the roller.

15. A method for manufacturing a developer roller, comprising the steps of:

(a) blending semiconductive silicone rubber stock by mixing dimethylpolysiloxane raw rubber with carbon black and fumed silica;

(b) adding spherical glass micro-powder and di-t-butyl-peroxide to the semiconductive silicone rubber stock and uniformly mixing the spherical glass micro-powder, di-t-butyl-peroxide, and semiconductive silicone rubber stock;

(c) molding the mixture obtained in said step (b) into a plate article;

(d) cutting the plate article;

(e) surrounding a shaft with the plate article, to form a roller and press vulcanizing the roller;

(f) again press vulcanizing the roller; and (g) grinding a surface of the roller.

16. A method for manufacturing a developer roller, comprising the steps of:

(a) blending semiconductive silicone rubber stock by mixing dimethylpolysiloxane raw rubber with carbon black and fumed silica;

(b) adding foam blowing agent and di-t-butyl-peroxide to the semiconductive silicone rubber stock and uniformly mixing the foam blowing agent, di-t-butyl-peroxide, and semiconductive silicone rubber stock;

(c) molding the mixture obtained in said step (b) into a plate article;

(d) cutting the plate article;

(e) surrounding a shaft with the plate article, to form a roller, and press vulcanizing the roller;

(f) again press vulcanizing the roller; and (g) grinding a surface of the roller.

* * * * *